US006427864B1

(12) United States Patent
Asselin

(10) Patent No.: US 6,427,864 B1
(45) Date of Patent: Aug. 6, 2002

(54) ACCESSORY CONDIMENT CONTAINER FOR DRINKING CUP

(76) Inventor: Randy P. Asselin, 11250 N. Sluice, Oro Valley, AZ (US) 85737

( * ) Notice: Subject to any disclaimer, the term of this patent is extended or adjusted under 35 U.S.C. 154(b) by 0 days.

(21) Appl. No.: 09/441,130

(22) Filed: Nov. 17, 1999

Related U.S. Application Data

(63) Continuation-in-part of application No. 09/032,432, filed on Feb. 27, 1998.

(51) Int. Cl.[7] ..... A47G 19/22; B65D 21/036

(52) U.S. Cl. ..... 220/709; 206/217; 206/501; 220/23.83; 220/521

(58) Field of Search ..... 220/574, 575, 220/574.1, 23.6, 23.83, 23.86, 521, 523, 524, 527, 212, 229, 703, 705, 707, 709; 215/387, 388; 229/400, 404; 206/217, 218, 501; 426/85, 110, 112, 115, 119, 120; D7/305, 590, 701

(56) References Cited

U.S. PATENT DOCUMENTS 2,327,077 A * 8/1943 Teetor ..... 220/23.86
3,064,800 A 11/1962 Hart
3,323,706 A * 6/1967 Gereke
4,183,444 A 1/1980 English et al.
4,458,584 A 7/1984 Annese et al.
4,478,346 A * 10/1984 Spong ..... 220/711
5,137,210 A 8/1992 Hibbs
5,180,079 A 1/1993 Jeng
5,429,262 A 7/1995 Sharkey
5,529,179 A 6/1996 Hanson
5,573,131 A * 11/1996 Berjis ..... 220/710 X
5,705,210 A 1/1998 Sillince et al.
5,722,558 A 3/1998 Thompson
D397,911 S * 9/1998 Waldmann ..... D7/507
5,954,195 A * 9/1999 Krueger et al. ..... 206/217
5,971,195 A * 10/1999 Reidinger et al. ..... 220/521
5,984,131 A * 11/1999 Kreuger et al. ..... 220/574

* cited by examiner

*Primary Examiner*—Lee Young
*Assistant Examiner*—Niki M. Eloshway
(74) *Attorney, Agent, or Firm*—Antonio R. Durando; Durando Birdwell & Janke, PLC

(57) ABSTRACT

A conventional lid for a drinking cup, a straw, and a ring-shaped container with an inner through-hole suitable for receiving the drinking straw are combined with the drinking cup. The straw is used to couple the container to the drinking cup by passing the straw trough the through-hole and through the cup's lid, such that the container is firmly anchored thereby. Thus, the condiment container is available to a user holding the cup without having to manage it as a separate item.

12 Claims, 3 Drawing Sheets

ACCESSORY CONDIMENT CONTAINER FOR DRINKING CUP

RELATED APPLICATIONS

This is a continuation in part application of U.S. Ser. No. 09/032,432, filed on Feb. 27, 1998, pending.

BACKGROUND OF THE INVENTION

1. Field of the Invention

This invention pertains to the field of fast-food packaging and containers. In particular, it relates to a disposable condiment container intended for use with a conventional soft-drink cup.

2. Description of the Related Art

A typical fast-food American meal includes a sandwich, french fried potatoes and a soft drink, and a handful of catchup packages or other condiments for dipping while consuming the meal. When eating seated at a table, people tend to squeeze the catchup into a container or on flat paper, such as the sandwich wrapping, so that they can dip the fries in it. On the other hand, when the meal is purchased "to go" and eaten in a motor vehicle, the process of dipping french fries in catchup or other condiment becomes problematic and cumbersome. Even it the condiment is served in a container, it is difficult to hold a sandwich with one hand, the drink with the other, and still be able from time to time to dip a fried potato in catchup and eat it. Thus, the process of consuming the typical American meal in a moving vehicle, especially while driving, requires more dexterity than most people possess and represents a well known inconvenience and some danger to safety.

The problem lies in the fact that people wish to be able to consume various items at the same time. Since each is available in a separate container, it is too difficult to manage them all well while sitting in a car seat. The process could be greatly aided by more stable containers capable of holding multiple items at the same time. Several inventions have been developed to address these concerns. For example, U.S. Pat. No. 4,183,444 to English et al. discloses a lid for a drink cup including a hanger hook for engaging a hole in a food container served with the drink. This arrangement allows the food and beverage to be handled together, simplifying the process of finding a suitable place for both while driving or being otherwise occupied.

U.S. Pat. No. 5,429,262 to Sharkey discloses the idea of an auxiliary condiment container with prongs for attachment to an associated foodstuff carton, such as a container of french fries. The auxiliary container is thus connected to the source of food for which it is intended. In a similar invention, U.S. Pat. No. 5,137,210 to Hibbs describes a beverage cup with a side pocket for holding a food product container. The food container is integral with the structure of the cup and derived from the same paperboard blank.

U.S. Pat. No. 5,180,079 to Jeng describes a stacked, two-cup structure for carrying a drink and an item of food in combination. The lower cup consists of a conventional drinking cup with a lid tailored for coupling with the upper cup through an upward-protruding nozzle at the center and a retaining ridge at the perimeter of the lid. The upper cup is sized to fit within the lid's retaining ridge and has a bottom with a vertical nozzle sleeve conforming to the lid's nozzle, so as to keep both cups securely connected. A drinking straw can be inserted through the nozzle for access to the drink.

These prior-art containers allow a patron to conveniently carry a food product and a beverage while freeing one of the patron's hands, but none of these inventions provides a simple solution to the problem of facilitating access to condiments while eating and drinking fast food contained in conventional packaging. Therefore, there is still a need for an improved approach. This invention is directed at combining a catchup container with a conventional soft-drink cup by adapting the container so that it can be connected to the cup simply with a straw, rather than by providing a specialized assembly dedicated to the task.

BRIEF SUMMARY OF THE INVENTION

The primary goal of this invention is a condiment container, such as a catchup package, that can be easily connected to a soft-drink cup and used for dipping finger food, such as french fries, without having to hold it as a separate item.

Another important objective is a condiment container that can be used with any drink cup, regardless of its shape, size or configuration.

Another objective is a container that can be connected to a conventional drink cup without modifications to the cup, so that it can be utilized with any standard drink container currently in use.

Finally, an objective of the invention is a condiment holder that is compatible with paper and plastic cups currently used by fast-food providers and is suitable for immediate utilization in commerce.

Therefore, according to these and other objectives, the present invention consists of the combination of a conventional lid for a drinking cup, a straw, and a ring-shaped container having an inner through-hole suitable for receiving the drinking straw.

The straw is used to couple the container to a drinking cup by passing the straw trough the through-hole and through the cup's lid, such that the container is firmly anchored thereby. Thus, the condiment container is available to a user holding the cup without having to manage it as a separate item.

Various other purposes and advantages of the invention will become clear from its description in the specification that follows. Therefore, to the accomplishment of the objectives described above, this invention consists of the features hereinafter illustrated in the drawings and fully described in the detailed description of the preferred embodiment and particularly pointed out in the claims. However, such drawings and description disclose but some of the various ways in which the invention may be practiced.

DESCRIPTION OF THE PREFERRED EMBODIMENTS OF THE INVENTION

The heart of this invention lies in the idea of providing a through-hole in a condiment container and using a straw inserted therethrough and through the lid of a drinking cup in order to couple the container to the cup. The straw provides an anchor that, alone, enables the stable engagement of the container to the cup in an upright position and makes it possible for a user to dip finger food into the container without having to hold on to it.

Figure 1:
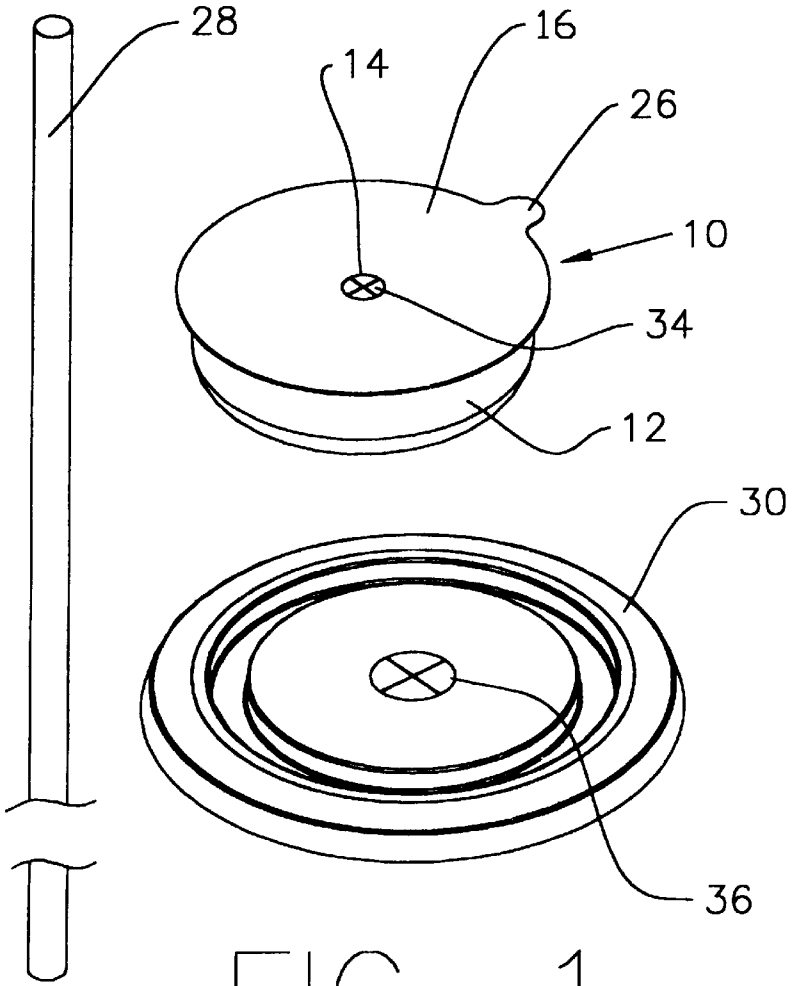
FIG. 1 is a perspective view of the top side of a condiment container sealed by a ring-shaped lid in combination with conventional lid and straw according to the invention.
Figure 3:
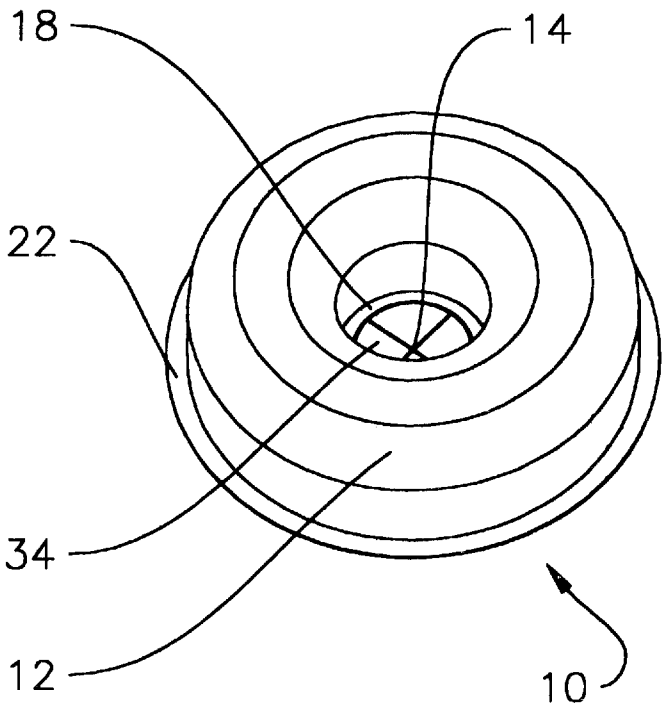
FIG. 3 is a perspective view of the bottom side of the condiment container of FIG. 1.
Figure 2:
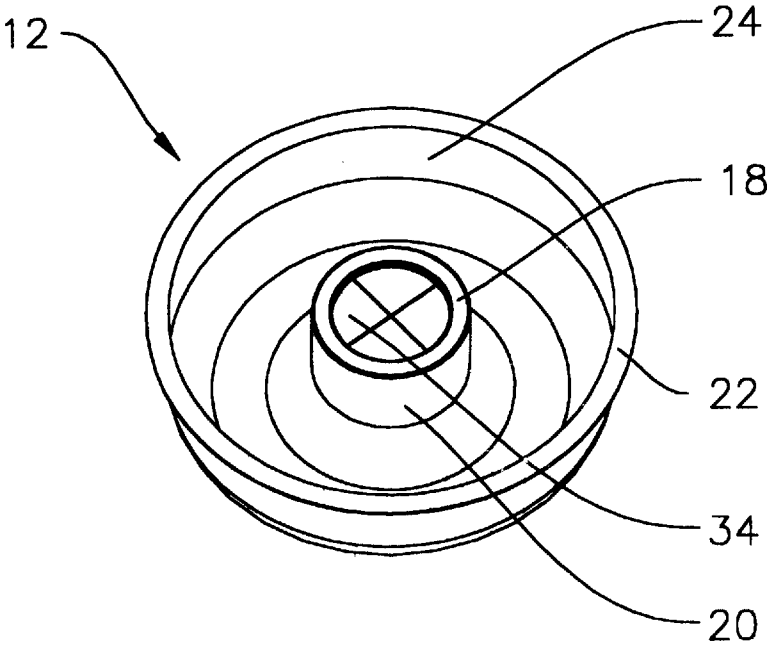
FIG. 2 is a perspective view of the top side of the condiment container of FIG. 1 after removal of the lid.

Referring to the drawings, wherein like reference numerals and symbols refer to like parts throughout, FIG. 1 is a perspective view of a condiment container 10 combined with a conventional drinking-cup lid 30 and a straw 28 according to the invention. The lid 30, as all standard-design lids for drink cups, has a perforation 36 that is substantially coplanar with the top of the lid. As seen more clearly in the view of FIG. 2, the holding structure 10 comprises a container 12, preferably annular in shape like a small bundt cake pan, with a central through-hole 14. The cake pan configuration of the container 12 and the through-hole 14 are also clearly seen in the bottom view of FIG. 3.

Figure 4:
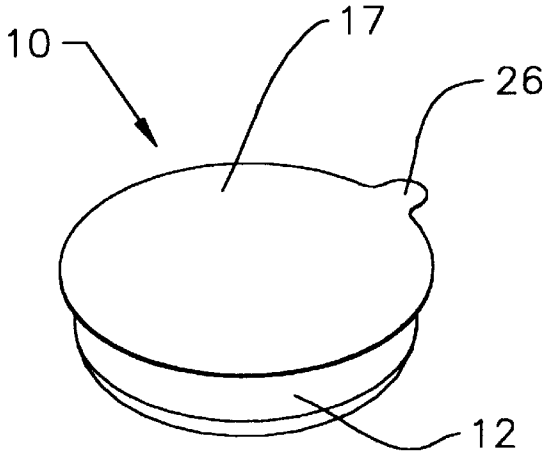
FIG. 4 is a perspective view of the top side of a condiment container according to the invention, shown sealed by a disk-shaped lid.

An annular lid 16, seen in FIG. 1, or a circular lid 17, shown in FIG. 4, are removably attached to the container 12 to seal the condiment package prior to use. As seen in the bottom view of FIG. 3 and in FIG. 2, where the lid has been removed, an inner lip 18 is preferably provided along the ridge of the inner wall 20 of the container 12 (also the top perimeter of the through-hole 14) and an outer lip 22 is provided along the ridge of the outer wall 24 of the container in order to facilitate the attachment of the lids 16 and 17 to the container 12. The lips 18 and 22 are preferably coplanar to maximize the holding capacity of the container 10 and to facilitate the manufacture of a sealed package. As in the case of similar prior-art sealed lids, a tab 26 is provided to peel the lid 16 or 17 off the container at the time of use.

Figure 5:
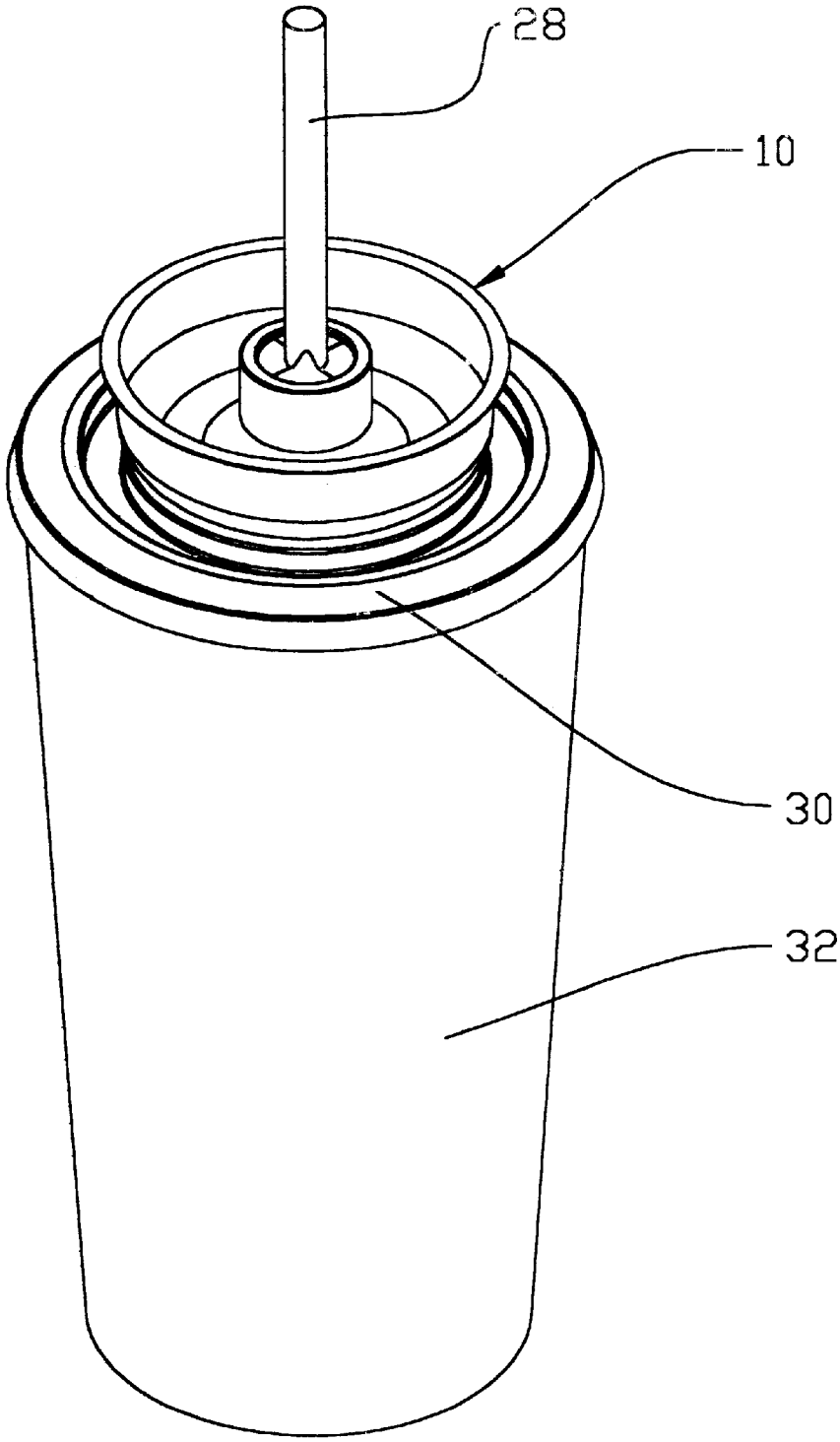
FIG. 5 is a perspective view of the condiment container assembly of the invention coupled to a conventional beverage cup by means of the straw.

The through-hole 14 is sized to receive in snug connection a conventional drinking straw 28 protruding upward from the lid 30 coupled to a drinking cup 32, as illustrated in FIG. 5. A through-hole with a diameter of about 10 to 20 mm was found to be optimal. Retaining protrusions 34 directed toward the center of the through-hole 14 may be incorporated into the design of the container 12 to strengthen its connection with the straw 28. Once so coupled to the cup 32, the condiment-container structure 10 becomes firmly anchored to a relatively massive item that is more stable than the container alone for the purpose of dipping finger food in it, especially when the cup 32 is relatively full of beverage.

In use, the lid 16 or 17 is removed to expose the contents of the container, such as catsup, which is thus available for consumption. The straw 28 is inserted into the cup 32 through the opposite hole 36 in the lid 30 (FIG. 1), as customary, and the container 12 is then slipped over the straw through the through-hole 14. The resulting assembly is illustrated in FIG. 5.

In the preferred embodiment of the invention, the container 12 is made of molded plastic and is sealed with conventional aluminum-foil or plastic lid material. The preferred size is from 60 to 80 mm in diameter, such that it can be placed on top of standard-size soft-drink cups. The preferred shape is annular, as illustrated in the drawings, with sufficient depth to accommodate the desired quantity of condiment. For example, a ring-shaped container about 70 mm in diameter with a through-hole 17 mm in diameter and 20 mm deep has a capacity of about 1.5 fluid ounces, comparable to standard-size catchup packages. While the annular configuration illustrated in the drawings is preferred, other plan shapes can obviously be employed, such as polygonal or irregular, so long as a through-hole is provided for engagement with a straw protruding from a lid firmly placed on a beverage cup.

Various changes in the details, steps and components that have been described may be made by those skilled in the art within the principles and scope of the invention herein illustrated. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope embraced by any and all equivalent processes and products.

I claim:

1. A condiment container assembly for use with a beverage cup, comprising:

a lid for the beverage cup, said lid having a central perforation substantially coplanar with a top of the lid;

a condiment container comprising a through-hole; and a drinking straw inserted through said central perforation in the lid and said through-hole in the container;

wherein the container is coupled to the beverage cup solely through the drinking straw and through frictional connection with the lid.

2. The assembly of claim 1, wherein the container includes coplanar inner and outer upper ridges, each ridge having a circumferential lip for attachment to a sealing lid for the container.

3. The assembly of claim 2, further comprising a sealing lid removably attached to said coplanar inner and outer upper ridges of the container.

4. The assembly of claim 3, wherein said sealing lid further comprises a tab for facilitating the removal of the sealing lid from the container.

5. The assembly of claim 4, wherein said container has an annular geometry.

6. The assembly of claim 5, further comprising retaining protrusions in the through-hole for strengthening a connection with the drinking straw.

7. The assembly of claim 4, further comprising retaining protrusions in the through-hole for strengthening a connection with the drinking straw.

8. The assembly of claim 3, wherein said container has an annular geometry.

9. The assembly of claim 3, further comprising retaining protrusions in the through-hole for strengthening a connection with the drinking straw.

10. The assembly of claim 1, wherein said container has an annular geometry.

11. The assembly of claim 1, further comprising retaining protrusions in the through-hole for strengthening a connection with the drinking straw.

12. A method of anchoring a condiment container to a beverage cup, comprising the following steps:

(a) placing a lid on the beverage cup, said lid having a central perforation substantially coplanar with a top of the lid;

(b) inserting a drinking straw through said central perforation of the lid;

(c) providing a condiment container comprising a through-hole adapted for engagement with said drinking straw; and (d) anchoring the container to the beverage cup solely through the drinking straw and through frictional connection with the lid.

* * * * *